US005090216A

United States Patent [19]

Waugh

[11] Patent Number: 5,090,216

[45] Date of Patent: Feb. 25, 1992

[54] ENHANCED GEMSTONE

[75] Inventor: John T. Waugh, Austin, Tex.

[73] Assignee: CJC Holdings, Inc., Austin, Tex.

[21] Appl. No.: 636,492

[22] Filed: Dec. 31, 1990

[51] Int. Cl.[5] ..... A44C 17/02

[52] U.S. Cl. ..... 63/26; 63/32

[58] Field of Search ..... 63/26, 32, 27

[56] References Cited

U.S. PATENT DOCUMENTS

| | | | |
|---|---|---|---|
| 250,379 | 12/1881 | Meyer . | |
| 1,319,251 | 10/1919 | Schless | 63/26 |
| 1,449,158 | 3/1923 | Wittstein | 63/27 |
| 2,261,958 | 11/1941 | Burri . | |
| 2,447,407 | 8/1948 | Grain . | |
| 3,528,261 | 9/1970 | Jones . | |
| 3,808,836 | 5/1974 | Jones . | |
| 3,835,665 | 9/1974 | Kitchel . | |
| 4,942,744 | 7/1990 | Wei . | |

FOREIGN PATENT DOCUMENTS

| | | | |
|---|---|---|---|
| 2621230 | 4/1989 | France | 63/26 |
| 8275 | 4/1894 | Switzerland . | |
| 649697 | 6/1985 | Switzerland | 63/26 |
| 588891 | 6/1947 | United Kingdom | 63/26 |
| 2110920 | 6/1983 | United Kingdom | 63/32 |

*Primary Examiner*—Gary L. Smith
*Assistant Examiner*—Michael Milano
*Attorney, Agent, or Firm*—Jones, Day, Reavis & Pogue

[57] ABSTRACT

An enhanced gemstone that has a semiprecious gemstone having a crown member with a table surface and a conical seat centered in the table surface. A precious stone is set in the conical seat with the pavilion member of the precious stone matching the angle of the conical seat. The precious stone is secured in the conical seat with means such as cement.

14 Claims, 1 Drawing Sheet

FIG. 1
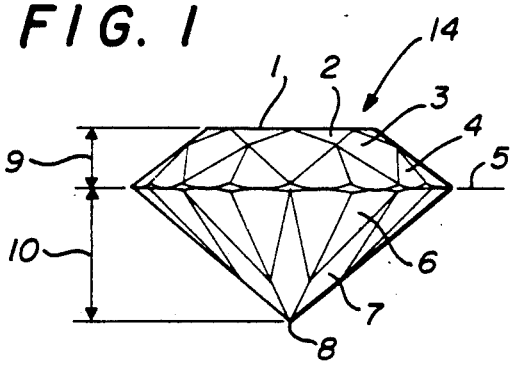
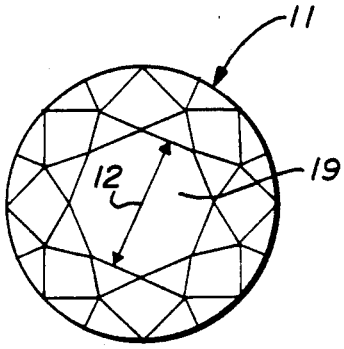
FIG. 2
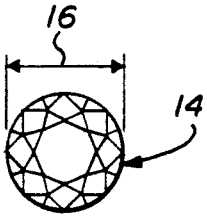
FIG. 3
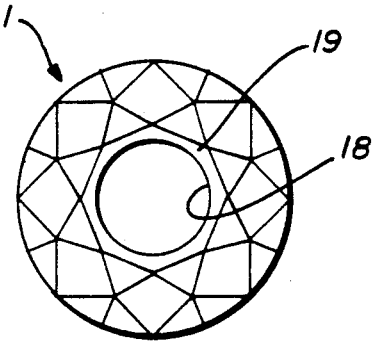
FIG. 4
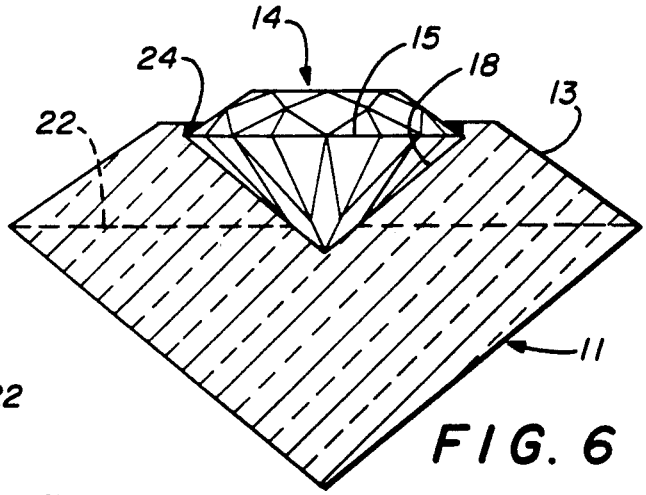
FIG. 6
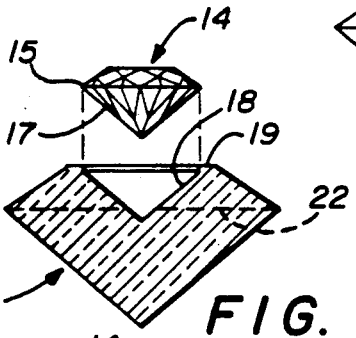
FIG. 5
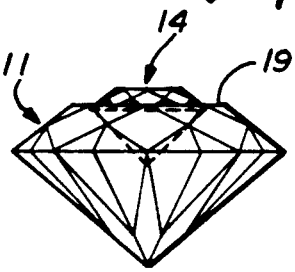
FIG. 7
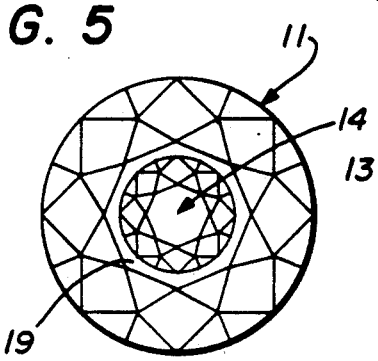
FIG. 8
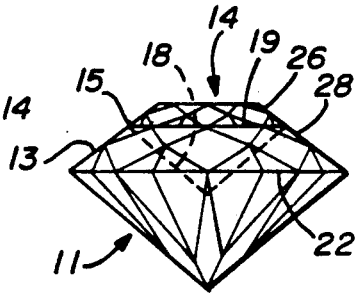
FIG. 9

ENHANCED GEMSTONE

FIELD OF THE INVENTION

The present invention relates to gemstones in general and in particular to an enhanced gemstone in which a semiprecious stone, such as a cubic zirconia, has a conical shaped seat formed in the crown table surface and in which a precious stone, such as a diamond, is seated with the pavilion of the precious stone having the same angle as the conical seat. The precious stone is then secured to the semiprecious stone in the well known manner such as with cement.

BACKGROUND OF THE INVENTION

Many different concepts and combinations have been used to enhance jewelry. Where small diamonds are involved, it is common to set them in a large metal setting having colors or designs that tend to cause the diamond or other precious stone to appear larger. In other instances, semiprecious stones of relatively large size have been mounted thereon or associated therewith in order to contrast precious stones of relatively smaller size. The contrast may be not only in size, cut and shape, but also in kind and/or color.

In combining relatively large and smaller stones in jewelry, it is customary to do so by setting the respective stones in metal with encrustations of relatively large stones by small stones. This necessitates setting the smaller stones in a metallic setting. The metallic setting is then secured to the larger stone. In some instances, the metallic setting is inserted within a recess in the larger stone. In such cases, the metallic setting not only detracts from the beauty of the stones, but is especially cumbersome and undesirable. In some instances, continuous grooves are cut into the large stone for receiving the body of smaller stones. The grooves are provided with undercut sidewalls and the shape of the small stones is such that the stones fit snugly in the grooves and the undercut sidewalls to permit them to be slid longitudinally in the groove. Such an article of jewelry is described in U.S. Pat. No. 2,261,958. In U.S. Pat. Nos. 2,447,407, 4,942,744 and 3,835,665, the reflection enhancement means have been placed in the base of the stone. In each of these patents, in the base of the stone there is embedded a device which enhances the reflection characteristics of the stone. Thus, each of the stones has a cavity which contains an illuminating element mounted inside the cavity.

In U.S. Pat. Nos. 3,528,261, 3,808,836, 250,379, and Swiss Patent No. 8,275, the lower portion of the stone is made of a material such as zircon while the upper portion of the stone is a diamond, sapphire or the like, and is bonded to the lower portion. In each of these cases, a crown of one type of gemstone is bonded to the pavilion of a second type of gemstone.

The present invention provides an improvement over the devices of the prior art by enhancing a gemstone by bonding a precious such as a diamond to a larger man-made stone such as a zirconia. Thus, a diamond is selected with a girdle diameter that is slightly less than the width of the crown table of a larger cubic zirconia. A diamond carving tool that is cone shaped is used to grind a seat in the table of the cubic zirconia to match the angle of the diamond pavilion. In the preferred embodiment, the conical seat is ground deep enough so that the diamond girdle is just below the crown table surface of the cubic zirconia. The diamond is then glued or cemented into the conical seat of the zirconia with enough glue to slightly cover the crown girdle facets of the diamond.

Thus it is an object of the present invention to provide an enhanced gemstone.

It is another object of the present invention to provide an enhanced gemstone which has a larger semiprecious stone with a seat in the crown table that receives a smaller precious gemstone.

It is also an object of the present invention to provide an enhanced gemstone in which a precious smaller stone is placed in a seat in the crown table of a larger semiprecious stone in which the precious stone girdle is just below the crown table surface of the larger semiprecious stone.

It is still another object of the present invention to provide an enhanced gemstone with a smaller semiprecious stone bonded to a seat in the crown table of a larger semiprecious stone in which the bonding material is a cement or a glue that slightly covers the crown girdle facets of the precious stone.

It is yet another object of the present invention to provide an enhanced gemstone in which a larger semiprecious stone has a recess in the table of the crown which receives a smaller precious stone such that the sloping shoulders of the crown of the precious stone are in alignment with the sloping shoulders of the crown of the semiprecious stone.

SUMMARY OF THE INVENTION

Thus the present invention relates to an enhanced gemstone comprising a semiprecious stone having a crown member with a table portion, a conical seat formed in the table portion of the semiprecious stone, a precious stone set in the conical seat, said precious stone having a pavilion member with a surface matching the angle of said conical seat, and means for securing the precious stone in the conical seat to form an enhanced gemstone.

The invention also relates to a method of forming an enhanced gemstone comprising the steps of selecting a semiprecious stone with a crown having a table with a first diameter, selecting a precious stone having a crown with girdle facets and a pavilion, said precious stone having a girdle diameter less than the first diameter of the table width of the semiprecious stone, forming a conical seat centered in the table of the semiprecious stone, the conical seat having an angle to match the pavilion surface of the precious stone, and securing the precious stone in the conical seat to form an enhanced gemstone.

BRIEF DESCRIPTION OF THE DRAWINGS

These and other objects of the present invention will be more fully understood in conjunction with the accompanying drawings in which like numbers indicate like components and in which:

FIG. 1 is an illustration of a gemstone illustrating the various elements forming the gemstone;

FIG. 2 is a top view of a semiprecious gemstone to be used in forming the enhanced gemstone of the present invention;

FIG. 3 is a top view of a precious gemstone such as a diamond that is to be used in conjunction with the semiprecious gemstone of FIG. 2 to form the enhanced gemstone of the present invention;

FIG. 4 is a top view of the semiprecious stone of FIG. 4 with a conical shaped seat therein to receive a precious gemstone;

FIG. 5 is a cross-sectional view of the semiprecious gemstone of FIG. 4 illustrating the conical shaped seat prepared for receiving the precious gemstone;

FIG. 6 is a cross-sectional view of the semiprecious gemstone illustrating the precious gemstone placed in the seat in the crown table of the semiprecious gemstone;

FIG. 7 is a side view of the present invention with the precious gemstone inserted in the seat in the semiprecious gemstone;

FIG. 8 is a top view of the gemstone of FIG. 7; and

FIG. 9 is a side view of an alternate embodiment of the present invention.

DETAILED DESCRIPTION OF THE DRAWINGS

FIG. 1 is a side view of a gemstone illustrating the various parts thereof. The crown portion is designated by the numeral 9 and extends upwardly from the girdle 5 and covers the entire upper portion. The pavilion 10 covers the entire lower portion below the girdle 5. The crown portion 9 has a table 1, star facets 2, bezel facets or crown main facets 3, crown girdle facets 4 and the girdle 5. The pavilion 10 includes the pavilion girdle facets 6, the pavilion main facets 7, and the culet 8.

A semiprecious stone 11 such as a cubic zirconia, for example only, may be selected for forming the enhanced gemstone of the present invention. The semiprecious gemstone 11 is illustrated in FIG. 2 and has a table diameter 12. A precious stone such as the diamond 14 illustrated in FIG. 3 has a diameter 16 at its girdle.

As illustrated in FIG. 4, the semiprecious stone 11 has a cone shaped seat 18 formed in the center of the table of the crown. In the preferred embodiment, conical shaped seat 18 has a diameter 20 at the table surface 19 that is slightly larger than the diameter 16 of the precious stone 14 at its girdle 15. The cross section of the semiprecious stone 11 is illustrated in FIG. 5 with the conical shaped seat shown prepared for receiving the precious stone 14. It should be noted that the angle of the pavilion 17 of precious stone 14 is the same angle as the shoulders of the conical seat 18. The precious stone 14 is then inserted in the conical shaped seat 18 as illustrated in FIG. 6. Since the girdle 15 of the precious gem 14 is slightly below the table surface 19 of crown 13 of the semiprecious stone 11, the cement 24 that is used to cement the semiprecious stone 14 into the conical seat 18 of the semiprecious stone 11, the glue or cement slightly covers the crown girdle facets or covers only a portion of the girdle facets (4 in FIG. 1) of the precious stone 14.

FIG. 7 is a side view of the completed enhanced gemstone and FIG. 8 is a top view of the completed enhanced gemstone.

In an alternate embodiment illustrated in FIG. 9, the conical shaped seat 18 in the semiprecious stone 11 is formed to a depth such that when the precious stone 14 is placed in the conical seat 18, the girdle 15 of the precious 14 is coterminous with the table surface 19 of the crown 13 of the semiprecious stone 11. This causes the shoulders 26 and 28 of the crown of the precious stone 14 and the crown of the semiprecious stone 11 to be in a direct line with each other thus giving the appearance of a single stone. However, in the preferred embodiment, the precious stone 14 has a girdle diameter slightly less than the table width of the semiprecious stone 11, thereby creating a small shoulder on the table surface 19 from which the precious gemstone projects. This is illustrated most clearly in FIG. 7.

Thus, there has been disclosed a novel enhanced gemstone in which a semiprecious stone has a crown with a table width of a first diameter. A precious stone has a crown with girdle facets and a pavilion and a girdle diameter less than the table width of the semiprecious stone and is matched with the semiprecious stone. A conical seat is centered in the table of the semiprecious stone with an angle to match the pavilion of the precious stone. The precious stone is then placed in the seat and secured therein to form the enhanced gemstone.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

I claim:

1. An enhanced gemstone comprising:

a semiprecious stone having a crown member with a table surface;

a conical seat centered in the table surface of the semiprecious stone;

a precious stone having a crown with girdle facets, a girdle with a diameter of less than the table surface width with the semiprecious stone and a pavilion member matching the angle of the conical seat;

the conical seat in the semiprecious stone having a depth such that the girdle of the precious gemstone is below the surface of the table of the semiprecious gemstone; and means for securing the precious stone in the conical seat to form an enhanced gemstone.

2. An enhanced gemstone according to claim 1 wherein the precious stone is set in the conical seat such that only the precious stone pavilion makes contact with the seat.

3. An enhanced gemstone as in claim 1 wherein cement is used to secure the precious gemstone pavilion in the seat of the semiprecious gemstone.

4. An enhanced gemstone as in claim 3 wherein the cement is a glue that covers only a portion of the girdle facets of the precious gemstone.

5. An enhanced gemstone as in claim 4 wherein the semiprecious stone is a cubic zirconia and the precious stone is a diamond.

6. An enhanced gemstone comprising:

a semiprecious stone having a crown member with a table surface;

a conical seat centered in the table surface of the semiprecious stone;

a precious stone having a crown with girdle facets, a girdle with a diameter less than the table surface width of the semiprecious stone and a pavilion member matching the angle of the conical seat;

the conical seat in the semiprecious stone having a depth such that the girdle of the precious stone is below the surface of the table of the semiprecious stone; and means for securing the precious stone in the conical seat of the semiprecious stone by securing the precious stone griddle facets to the semiprecious stone.

7. An enhanced gemstone comprising:

a semiprecious stone having a crown member with a table surface;

a conical seat centered in the table surface of the semiprecious stone;

a precious stone having a crown with girdle facets, a pavilion member matching the angle of the conical seat and a girdle;

the conical seat in the semiprecious stone having a depth such that when the precious stone is placed in the conical seat, the girdle of the precious stone is coterminous with a table surface of the crown of the semiprecious stone;

the crown of the precious stone and the crown of the semiprecious stone forming a direct line with each other thus providing the appearance of a single stone; and means for securing the precious stone in the conical seat to form the enhanced gemstone.

8. An enhanced gemstone as in claim 7 wherein cement is used to secure the precious gemstone pavilion to the seat of the semiprecious gemstone.

9. An enhanced gemstone as in claim 8 wherein cement is a glue that covers only a portion of the girdle facets of the precious gemstone.

10. An enhanced gemstone as in claim 9 wherein the semiprecious stone is a cubic zirconia and the precious stone is a diamond.

11. A method of forming an enhanced gemstone comprising the steps of:

selecting a semiprecious stone having a crown member with a table surface;

selecting a precious stone having a crown with a girdle facet and a pavilion, the precious stone having a girdle diameter less than the table width of the semiprecious stone;

forming a conical seat centered in the table in the semiprecious stone, the conical seat having an angle to match the pavilion of the precious stone;

forming a conical seat with a depth such that the girdle of the precious gemstone is below the surface of the table of the semiprecious gemstone; and securing the precious gemstone pavilion in the seat of the semiprecious gemstone with cement.

12. A method as in claim 11 further comprising the step of using glue as the cement, the glue covering only a portion of the girdle facets of the precious gemstone.

13. A method as in claim 11 further comprising the steps of:

using a cubic zirconia as the semiprecious gemstone; and using a diamond as the precious gemstone.

14. A method of forming an enhanced gemstone comprising the steps of:

selecting a semiprecious stone having a crown member with a table surface;

selecting a precious stone having a crown with girdle facets in a pavilion, the precious stone having a girdle diameter less than the table width of the semiprecious stone;

forming a conical seat centered in the table of the semiprecious stone, the conical seat having an angle to match the pavilion of the precious stone;

forming the conical seat in the semiprecious stone to a depth that when the precious stone is placed in the conical seat, the girdle of the precious stone is coterminous with the table surface of the crown of the semiprecious stone;

forming a composite enhanced gemstone wherein the crown of the precious stone and the crown of the semiprecious stone are joined sharing a direct line with each other, thus providing the appearance of a single stone; and means for securing the precious stone in the conical seat to form the enhanced gemstone.

* * * * *

UNITED STATES PATENT AND TRADEMARK OFFICE

CERTIFICATE OF CORRECTION

PATENT NO. : 5,090,216

DATED : February 25, 1992

INVENTOR(S) : John T.Waugh

It is certified that error appears in the above-identified patent and that said Letters Patent is hereby corrected as shown below:

Column 4, Line 67, "griddle" should read --girdle--.

Column 6, Line 12, "11" should read --12--.

Signed and Sealed this

Fourth Day of January, 1994

*Attest:*

Bruce Lehman

BRUCE LEHMAN

*Attesting Officer*

*Commissioner of Patents and Trademarks*